US009846013B2

(12) United States Patent
Davies et al.

(10) Patent No.: US 9,846,013 B2
(45) Date of Patent: Dec. 19, 2017

(54) VEHICLE ARMOUR

(71) Applicant: NP Aerospace Limited, Coventry (GB)

(72) Inventors: Christopher Davies, Kenilworth (GB); Roger Medwell, Coventry (GB)

( * ) Notice: Subject to any disclaimer, the term of this patent is extended or adjusted under 35 U.S.C. 154(b) by 0 days.

(21) Appl. No.: 14/774,705

(22) PCT Filed: Mar. 5, 2014

(86) PCT No.: PCT/GB2014/050653

§ 371 (c)(1),
(2) Date: Sep. 11, 2015

(87) PCT Pub. No.: WO2014/140531

PCT Pub. Date: Sep. 18, 2014

(65) Prior Publication Data

US 2016/0025458 A1 Jan. 28, 2016

(30) Foreign Application Priority Data

Mar. 13, 2013 (GB) ..... 1304900.2

(51) Int. Cl.
*F41H 5/04* (2006.01)
*F41H 5/02* (2006.01)
*F41H 7/00* (2006.01)

(52) U.S. Cl.
CPC ..... *F41H 5/0428* (2013.01); *F41H 5/023* (2013.01); *F41H 7/00* (2013.01)

(58) Field of Classification Search
CPC ..... F41H 5/042; F41H 5/04358
(Continued)

(56) References Cited

U.S. PATENT DOCUMENTS 3,516,898 A 6/1970 Cook
5,499,568 A * 3/1996 Turner ..... F41H 5/013 109/79

(Continued)

FOREIGN PATENT DOCUMENTS

EP 1734332 A2 12/2006
EP 2204631 A2 7/2010

(Continued)

OTHER PUBLICATIONS

International Patent Application No. PCT/GB2014/050653, International Search Report and Written Opinion dated May 16, 2014.

*Primary Examiner* — Jason S Morrow
(74) *Attorney, Agent, or Firm* — Kilpatrick Townsend & Stockton LLP; Dean W. Russell

(57) ABSTRACT

Vehicle armor may include an assembly of components including an outer armor pack, an air gap, an inner armor pack, and a high energy absorbing layer. At least one version of the outer armor pack may include an outermost outer fiber reinforced composite protective layer of ≥1 mm thickness, an outer ceramic armor layer, and an inner fiber reinforced composite support layer to absorb residual energy from small arms. The air gap may be between 1-10 mm to allow for deflection of the outer armor pack. The inner armor pack may include an outer fiber reinforced composite protective layer of ≥0.5 mm thickness, an inner segmented ceramic armor layer, and an innermost inner fiber reinforced composite layer of ≥10 mm thickness. The high energy absorbing layer may have ≥25 mm thickness and be configured to mitigate the effect of residual fragments defeating the outer and inner armor packs.

18 Claims, 2 Drawing Sheets

(58) Field of Classification Search
USPC ..... 296/187.07; 89/36.02, 36.08
See application file for complete search history.

(56) References Cited

U.S. PATENT DOCUMENTS

| | | | | |
|---|---|---|---|---|
| 6,601,497 | B2 | 8/2003 | Ghiorse et al. | |
| 8,151,686 | B2 | 4/2012 | Ravid et al. | |
| 2010/0330341 | A1 | 12/2010 | Percival et al. | |
| 2011/0030543 | A1* | 2/2011 | Ravid | F41H 5/04 89/36.02 |
| 2011/0192275 | A1* | 8/2011 | Medwell | F41H 7/04 89/36.08 |
| 2012/0183716 | A1* | 7/2012 | Jordan | B29C 70/088 428/47 |
| 2012/0186432 | A1* | 7/2012 | St. Claire | F41H 5/023 89/36.02 |
| 2015/0114211 | A1 | 4/2015 | Medwell et al. | |
| 2015/0143984 | A1 | 5/2015 | Medwell et al. | |
| 2015/0176950 | A1 | 6/2015 | Moran et al. | |
| 2015/0184979 | A1 | 7/2015 | Moran et al. | |
| 2015/0377595 | A1* | 12/2015 | Scarinci | F41H 5/0407 89/36.02 |

FOREIGN PATENT DOCUMENTS

| | | | |
|---|---|---|---|
| FR | 2803379 | A1 | 7/2001 |
| WO | 2006103431 | A1 | 10/2006 |

* cited by examiner

VEHICLE ARMOUR

CROSS-REFERENCE TO RELATED APPLICATIONS

This application is the U.S. national phase entry of International Patent Application No. PCT/GB2014/050653, entitled "VEHICLE ARMOUR," filed Mar. 5, 2014, which application claims the benefit of United Kingdom Patent Application No. 1304900.2, entitled "VEHICLE ARMOUR," filed Mar. 13, 2013, the entire disclosures of both of which are hereby incorporated herein by reference.

This invention relates to vehicle armour.

Armour for vehicles has to meet a number of constraints. Vehicle armour needs to:—

- protect against the different types of threat a vehicle is expected to encounter;
- be of sufficiently low weight as not to unduly impede vehicle speed; and
- be of sufficiently low bulk as not to unduly impede vehicle manoeuvrability.

The benchmark against which armour tends to be assessed is rolled homogeneous armour (RHA) a hot rolled steel.

U.S. Pat. No. 8,151,686 discloses armour aimed at protecting against an explosively formed projectile [EFP] and comprising a hard layer disposed facing the threat; a unidirectional fiber layer disposed behind said hard layer; and a catcher layer behind said unidirectional fiber layer.

Disclosed in U.S. Pat. No. 8,151,686 is armour that is alleged to have the same level of ballistic protection against an EFP threat but at a lower areal density than for RHA [385.7 kg/m$^2$ as compared with 1040 kg/m$^2$].

This lower areal density comes with a penalty of increased thickness. An areal density of 1040 kg/m$^2$ for RHA implies a thickness of about 13.25 cm. The armour exemplified in U.S. Pat. No. 8,151,686 has an overall thickness exterior to the vehicle hull of 35.02 cm. This near tripling in thickness poses design problems for armouring vehicles, particularly around hatches, and decreases vehicle manoeuvrability with a consequent increase in minor damage through impacts.

The armour used in the example of U.S. Pat. No. 8,151,686 uses two steel plates and one segmented ceramic plate to provide the required level of protection against EFP threats.

The steel plate first encountered by the EFP is intended to provide significant protection against the EFP. The succeeding layers between that steel plate and the segmented ceramic plate are designed to:—

- wrap around fragments that defeat the steel plate;
- provide space for fragments to disperse; and
- catch the fragments thereafter.

This results in a significant part of the thickness of the armour used in the example of U.S. Pat. No. 8,151,686 [22.6 cm of the overall 35.02 cm] lying between the front steel plate and the segmented ceramic plate.

Further, this arrangement places the armour destined to shield against EFP threats exposed to damage from small arms fire and from minor vehicle collisions, which could compromise the integrity of the armour.

U.S. Pat. No. 8,151,686 uses a steel outer armour which, to some extent, will be tolerant of vehicle collisions, a "fender bender" will be just that. However, U.S. Pat. No. 8,151,686 provides no means of coping with such collisions where the outer armour is of ceramic, and the use of steel imposes a weight penalty in comparison with ceramic. The inventors have provided armour that maximises the use of ceramic and provides protection to the ceramic to prevent damage in the event of collision.

In the following:—

- the word "outer" means further from the vehicle hull and the word "inner" means closer to the vehicle hull;
- the word "penetrator" means one or more projectiles and includes explosively formed projectiles;
- where limits to a range are described any limit mentioned as a minimum may be combined with any limit mentioned as a maximum.

The applicants have realised that improved vehicle armour may be provided comprising an assembly of:— a) an outer armour pack comprising:—
   - i) an outermost outer fibre reinforced composite protective layer of at least 1 mm thickness;
   - ii) an outer ceramic armour layer to protect against small arms and provide initial fragmentation of a penetrator; and
   - iii) an inner fibre reinforced composite support layer to absorb residual energy from small arms;
   - the outermost outer fibre reinforced composite protective layer being configured to protect the outer ceramic armour layer against minor impacts;

b) an air gap of between 1 mm and 10 mm to allow for deflection of the outer armour pack;

c) an inner armour pack comprising;
   - i) an outer fibre reinforced composite protective layer of at least 0.5 mm thickness;
   - ii) an inner segmented ceramic armour layer configured to provide the majority of protection against a penetrator;
   - iii) an innermost inner fibre reinforced composite layer of at least 10 mm thickness; the outer fibre reinforced composite protective layer being configured to protect the inner segmented ceramic armour layer against damage during handling or maintenance of the armour d) a high energy absorbing layer of at least 25 mm thickness configured to mitigate the effect of residual fragments defeating the outer and inner armour packs.

the armour being configured to be mounted in spaced relationship to the hull of a vehicle.

Further details and feature of armour as claimed are set out in the claims and in the following illustrative description with reference to the drawings in which:—

Figure 1:
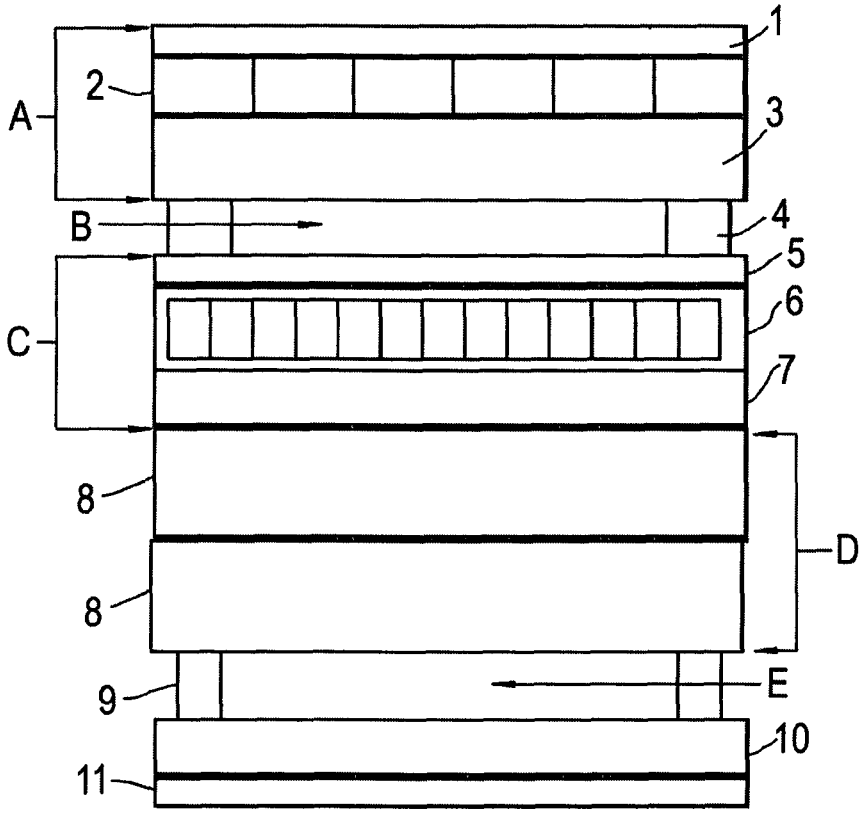
FIG. 1 is a schematic view of armour as claimed.
Figure 2:
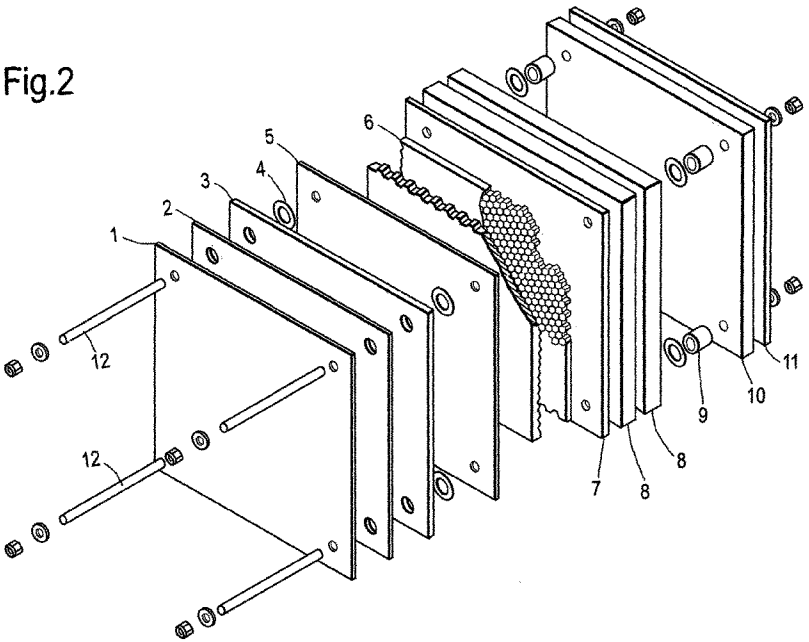
FIG. 2 is an exploded sectional view of an armour panel.

Armour comprises:— an outer armour pack A;

spaced by an air gap B from;

an inner armour pack C; and a high energy absorbing layer D of at least 25 mm thickness configured to mitigate the effect of residual fragments defeating the outer and inner armour packs.

The outer armour pack A comprises an outermost outer fibre reinforced composite protective layer 1 of at least 1 mm thickness; an outer ceramic armour layer 2 to protect against small arms and provide initial fragmentation of a penetrator; and an inner fibre reinforced composite support layer 3 to absorb residual energy from small arms.

The outermost outer fibre reinforced composite protective layer 1 may comprise one or more layers and acts to protect the outer ceramic armour layer against minor impacts, e.g. low speed impacts. To some extent, the thicker this layer the better to protect the ceramic armour layer 2 from damage. A typical thickness might be 2 mm-10 mm. Suitable materials include any material that can protect against blunt trauma.

The fibres of the reinforced composite may be of any suitable type and includes without limitation, glass fibres, ceramic fibres, carbon fibres, polymer fibres (for example, but not limited to aramids), and mixtures thereof. The matrix of the composite material may be of any suitable type and includes without limitation thermoplastic materials and thermosetting materials. The fibres of the composite may be in the form of:— unidirectionally disposed fibres which may be aligned or disposed cross-laid at any required angle;

woven fibres; or mixtures of woven and unidirectionally disposed fibres.

The outer ceramic armour layer 2 may be segmented armour and may comprise tiles or pellets of ceramic and the ceramic may be of any ballistically suitable type, including without limitation; alumina, silicon carbide, boron carbide, and composite ceramics. Typically the thickness is greater than 4 mm, but thickness depends on threat level.

The inner fibre reinforced composite support layer 3 may be of identical or different composition to the outermost fibre reinforced composite protective layer 1 but is provided with a thickness sufficient to absorb residual energy from small arms impacting the outer armour pack A. A typical thickness might be 10-20 mm but thicknesses outside this range [particularly greater thicknesses to combat higher small arms threat levels] are contemplated.

The outer armour pack A is spaced from an inner armour pack C by an air gap B. The spacing is maintained by spacers 4 which may be in the form of washers, as shown, strips or any other shape that may maintain the air gap. The spacers 4 may be stiff or may be of a resilient material to absorb energy in the event of impact. Steel or aluminium are suitable materials for the spacers. The air gap 4 may be relatively small as its presence is required to provide a degree of deflection before energy is transferred to the inner armour pack C. A thickness of 1 to 10 mm may suffice but greater than or equal to 2 mm is preferred to permit greater deflection, and less than or equal to 8 mm is preferred to minimise overall armour thickness.

The inner armour pack C comprises i) an outer fibre reinforced composite protective layer 5 of at least 0.5 mm thickness;

ii) an inner segmented ceramic armour layer 6 configured to provide the majority of protection against a penetrator;

iii) an innermost inner fibre reinforced composite layer 7 of at least 10 mm thickness.

The outer fibre reinforced composite protective layer 5 is configured to protect the inner segmented ceramic armour layer 6 against damage during handling or maintenance of the armour. The outer fibre reinforced composite protective layer 5 may be of identical or different composition to the outermost fibre reinforced composite protective layer 1 but as it is intended primarily to protect against handling or maintenance may of less thickness than the outermost fibre reinforced composite protective layer 1. A typical thickness might be greater than 1 mm or greater than 2 mm, or less than 10 mm or less than 5 mm.

The inner segmented ceramic amour layer 6 may comprise tiles or pellets embedded in a resin, and may, for example and without limitation, comprise a layer as disclosed in U.S. Pat. No. 6,601,497, EP1734332, WO2006/103431, or U.S. Pat. No. 8,151,686. The segments of the inner segmented ceramic amour layer 6 may be of any suitable shape and includes, for example and without limitation, square, rectangular or hexagonal tiles, or tiles or pellets of any of the shapes disclosed in the above mentioned documents. The ceramic of the inner segmented ceramic amour layer 6 may be of any ballistically suitable ceramic and includes, without limitation alumina, silicon carbide, boron carbide, and composite ceramics. The specific material and the thickness of ceramic in the inner segmented ceramic amour layer 6 are selected to deal with a chosen threat level. Typical thicknesses might be 15 mm or more. The greater the threat the greater the appropriate thickness for a given material.

The innermost inner fibre reinforced composite layer 7 is of at least 10 mm thickness and may be up to 20 mm, 40 mm, or even more, dependent on the threat level and the degree of support required. The innermost inner fibre reinforced composite layer 7 is intended to provide support to the inner segmented ceramic amour layer 6 in the event of a ballistic impact. The innermost inner fibre reinforced composite layer 7 may be of identical or different composition to the inner fibre reinforced composite support layer 3, but a preferred material is a carbon fibre composite, as providing a high stiffness with a low weight. Energy absorption properties are not so important for the materials of this layer as the degree of stiffness and support it provides to the inner segmented ceramic amour layer 6.

Behind the inner armour pack C is a high energy absorbing layer D of at least 25 mm thickness. This is configured to mitigate the effect of residual fragments defeating the outer and inner armour packs. The thickness required is a factor of the efficiency of the rest of the armour. Thicknesses of greater than 30 mm, greater than 55 mm, greater than 60 mm, greater than 70 mm, or greater than 80 mm are within the contemplation of the inventors.

Several layers may be provided to give the required thickness and the drawings show two layers 8 of thickness that may be less than 25 mm totalling together over 25 mm.

In similar manner, it should be noted that any one of the layers 1,2,3, 5,6,7 of the claimed armour may comprise several separate layers.

The material for high energy absorbing layer D may comprise high molecular weight polyethylene [e.g. Dyneema™ or SpectraShield™], high molecular weight polypropylene [e.g. Tegris™], any other suitable material.

The high energy absorbing layer D may be in contact with or spaced from the inner armour pack C, but advantageously is in contact to offer additional support to the ceramic segments.

The armour is configured to permit mounting of the assembly of the outer armour pack A;

the air gap B from;

the inner armour pack C; and the high energy absorbing layer D in spaced relationship to the hull 11 of a vehicle to provide an air gap E.

The drawings show [as an optional feature] an interface plate 10 to assist mounting of the armour to the hull 11. The interface plate 10 may be of a material and thickness chosen to provide some further ballistic resistance, for example of steel or aluminium.

The air gap E may be maintained by spacers 9 which may be stiff or resilient and may be of identical or different materials to spacers 4.

The entire assembly may be held together by bolts 12 passing through holes in the separate integers of the armour. The outer armour pack A; the inner armour pack C; and the high energy absorbing layer D may be provided as separate components and assembled and mounted to the hull in situ. The outer armour pack A and inner armour pack C may be provided as an assembled body for mounting with the high energy absorbing layer D to the hull. The inner armour pack C may be mounted to the hull and the outer armour pack A mounted to the inner armour pack, thereby facilitating replacement of the outer armour pack A without necessitating complete dismantling of the armour.

Adhesives may be used to join the integers of the outer armour pack A together; and may be used to join the integers of the inner armour pack C together. Preferably the adhesive has significant flexibility.

An example of armour as claimed comprises the components:—

| Component | Detail |
|---|---|
| outermost outer fibre reinforced composite protective layer 1 | Nominal 3 mm thick phenolic resin impregnated S2 glass [HJ1 - obtainable from Agy] comprising 6 layers cross lapped 0/90/0/90/0/90 |
| outer ceramic armour layer 2 | 6 mm thick alumina tiles 95% nominal $Al_2O_3$ with density 3.73 cc/g or more |
| inner fibre reinforced composite support layer 3 | Nominal 15 mm thick resin impregnated S2 glass comprising 30 layers cross lapped 0/90/ . . . /0/90 |
| spacers 4 | 2 mm thick washer |
| outer fibre reinforced composite protective layer 5 | Nominal 2 mm thick phenolic resin impregnated S2 glass [HJ1 - obtainable from Agy] comprising 4 layers cross lapped 0/90/0/90 |
| inner segmented ceramic armour layer 6 | 19 ± 0.2 mm thick hexagonal ballistic alumina tiles 98.6% nominal $Al_2O_3$ with density 3.86 cc/g or more embedded in resin [Desmopan 385 obtainable from Bayer Material Science]. |
| innermost inner fibre reinforced composite layer 7 | Nominal 12.5 mm carbon fibre 27 ± 1 layers 0/90/0/90 etcetera |
| high energy absorbing layer D | 2 layers of 32 mm thick Dyneema ™ HB26 112 layers 0/90/ . . . /0/90 |
| spacers 9 | 2 mm thick washer and 35 mm spacer |
| Interface plate 10 | 25 mm thick aluminium plate |
| Adhesive | Nominal 0.25 mm thick layers Arbokol 2150 obtainable from Adshead Ratcliffe & Co Ltd, bonding material disposed between:- outermost outer fibre reinforced composite protective layer 1 and outer ceramic armour layer 2; outer ceramic armour layer 2 and inner fibre reinforced composite support layer 3; outer fibre reinforced composite protective layer 5 and inner segmented ceramic armour layer 6; inner segmented ceramic armour layer 6 and innermost inner fibre reinforced composite layer 7; and optionally innermost inner fibre reinforced composite layer 7 and high energy absorbing layer D |

The above description is illustrative only and it will be evident to the skilled person that modifications and variants may be applied while still within the scope and spirit of the invention. Particular variants may be in the selection of materials for the different layers and the present invention contemplates use of both known and future materials in the invention.

The following claims use multiple dependencies. For the avoidance of doubt the present application discloses and covers each and every combination of features disclosed by any combination of claims.

The invention claimed is:

1. Vehicle armour configured to be mounted in spaced relationship to the hull of a vehicle, the vehicle armour comprising an assembly of:

a) an outer armour pack comprising:

i) an outermost outer fibre reinforced composite protective layer of at least 1 mm thickness;

ii) an outer ceramic armour layer to protect against small arms and provide initial fragmentation of a penetrator; and iii) an inner fibre reinforced composite support layer to absorb residual energy from small arms;

the outermost outer fibre reinforced composite protective layer being configured to protect the outer ceramic armour layer against minor impacts;

b) an air gap of between 1 mm and 10 mm to allow for deflection of the outer armour pack;

c) an inner armour pack comprising;

i) an outer fibre reinforced composite protective layer of at least 0.5 mm thickness;

ii) an inner segmented ceramic armour layer configured to provide the majority of protection against a penetrator;

iii) an innermost inner fibre reinforced composite layer of at least 10 mm thickness;

the outer fibre reinforced composite protective layer being configured to protect the inner segmented ceramic armour layer against damage during handling or maintenance of the armour; and d) a high energy absorbing layer of at least 25 mm thickness configured to mitigate the effect of residual fragments defeating the outer and inner armour packs.

2. Vehicle armour as claimed in claim 1, in which the outermost outer fibre reinforced composite protective layer has a thickness of 2 mm-10 mm.

3. Vehicle armour as claimed in claim 1, in which the outer ceramic armour layer is a segmented ceramic layer.

4. Vehicle armour as claimed in claim 1, in which the inner fibre reinforced composite support layer is of the same composition as the outermost outer fibre reinforced composite protective layer.

5. Vehicle armour as claimed in claim 1, in which the inner fibre reinforced composite support layer has a thickness of 10-20 mm.

6. Vehicle armour as claimed in claim 1, in which the air gap is greater than or equal to 2 mm and/or less than or equal to 8 mm.

7. Vehicle armour as claimed in claim 1, in which outer fibre reinforced composite protective layer is of the same composition as the outermost outer fibre reinforced composite protective layer.

8. Vehicle armour as claimed in claim 1, in which the outer fibre reinforced composite protective layer is of thickness greater than 1 mm.

9. Vehicle armour as claimed in claim 1, in which the inner segmented ceramic armour layer comprises ceramic tiles embedded in a resin.

10. Vehicle armour as claimed in claim 1, in which the innermost inner fibre reinforced composite layer comprises a carbon fibre composite.

11. Vehicle armour as claimed in claim 1, in which the high energy absorbing layer comprises high molecular weight polyethylene and/or high molecular weight polypropylene.

12. Vehicle armour as claimed in claim 1, further comprising an interface plate to assist mounting of the armour to a hull.

13. A vehicle armoured with the armour of claim 1 mounted thereto.

14. Vehicle armour as claimed in claim 8, in which the outer fibre reinforced composite protective layer is of thickness greater than 2 mm.

15. Vehicle armour as claimed in claim 8, in which the outer fibre reinforced composite protective layer is of thickness less than 10 mm.

16. Vehicle armour as claimed in claim 8, in which the outer fibre reinforced composite protective layer is of thickness less than 5 mm.

17. Vehicle armour as claimed in claim 14, in which the outer fibre reinforced composite protective layer is of thickness less than 5 mm.

18. Vehicle armour as claimed in claim 10, in which the innermost inner fibre reinforced composite layer consists of a carbon fibre composite.

* * * * *